US005524783A

United States Patent [19]

Popoff

[11] Patent Number: 5,524,783

[45] Date of Patent: Jun. 11, 1996

[54] SELF-SUPPORTING AIR REMOVAL DEVICE FOR USE WITH A NURSING BOTTLE

[75] Inventor: Robert Popoff, Dearborn, Mich.

[73] Assignee: Cherub Products, Inc., Dearborn, Mich.

[21] Appl. No.: 402,877

[22] Filed: Mar. 13, 1995

[51] Int. Cl.[6] ..... A61J 9/06

[52] U.S. Cl. ..... 215/386; 215/11.1; 215/11.3; 215/11.6

[58] Field of Search ..... 215/11.3, 11.6, 215/326; 248/102, 105, 346.1

[56] References Cited

U.S. PATENT DOCUMENTS

| | | | |
|---|---|---|---|
| 2,451,846 | 10/1948 | Love et al. | 248/105 |
| 2,733,883 | 2/1956 | Gourley | 248/105 |
| 2,968,888 | 1/1961 | Borah | 248/346.1 |
| 3,058,708 | 10/1962 | Murray et al. | 248/102 |
| 3,648,873 | 3/1972 | Grobbel | 215/11.3 |
| 4,784,641 | 11/1988 | White | 215/11.1 X |
| 4,796,767 | 1/1989 | McKeown | 215/11.1 |
| 4,869,381 | 9/1989 | Agner | 248/102 X |
| 4,880,125 | 11/1989 | LeBeau | 215/11.3 |
| 4,979,629 | 12/1990 | Askerneese | 215/11.3 X |
| 5,033,631 | 7/1991 | Nightingale | 215/11.3 X |
| 5,109,996 | 5/1992 | Sullivan | 215/11.1 X |
| 5,301,825 | 4/1994 | Di Scala et al. | 215/11.1 |
| 5,356,016 | 10/1994 | Wiedemann | 215/11.1 X |

*Primary Examiner*—Sue A. Weaver
*Attorney, Agent, or Firm*—Harness, Dickey & Pierce

[57] ABSTRACT

A plunger with a base, upwardly extending shank, and tip receives an open bottom of a nursing bottle having a liquid filled sack in order to expel air from within the sack. Preferably, a trough is formed in the base about the shank for collecting liquid run over which escapes the sack during pressurization with the tip. Preferably, the base includes a plurality of vertically extending faces which allow the plunger to rest on a horizontal surface without rolling when storing the plunger subsequent to use.

10 Claims, 2 Drawing Sheets

SELF-SUPPORTING AIR REMOVAL DEVICE FOR USE WITH A NURSING BOTTLE

FIELD OF THE INVENTION

This invention relates to air removal devices for nursing bottles, and more particularly to a self-supporting plunger preferably for mating with an open base nursing bottle of a type having a liquid holding collapsible sack so as to compress the sack and expel air therefrom.

BACKGROUND OF THE INVENTION

Traditional baby bottles used for bottle feeding an infant were constructed from glass, or later on, plastic. A cap and nipple assembly were constructed to mate in threading engagement with an open mouth on the bottle. Prior to using them, it was necessary to sterilize the bottle, cap, and nipple by boiling them in water, which greatly increased the time required to prepare and fill the baby bottle in response to a hungry infant's cries. Furthermore, in use, the liquid removed by an infant from these bottles during feeding will create a vacuum inside the bottle, which eventually pulls air inside the bottle through the nipple opening. As a result, a feeding infant will frequently ingests air through the bottle nipple during feeding, which results in discomfort to the infant, and indirectly to the parents.

Subsequent improvements made to baby bottles have resulted in nursing bottles of a type having a liquid holding collapsible sack which is carried inside a protective cylindrical housing. The sack has an open top end with a sealed bottom which is inserted within the housing, afterwhich a terminating edge portion of the top end of the sack is folded over the housing end. The sack is held in this position and liquid is poured into the sack while it is suspended in the cylinder, afterwhich a threaded cap including a nipple is threadingly mated to an outer diameter end threaded portion of the housing which traps and seals the sack with the cap and housing. However, during this procedure it is virtually impossible to avoid sealing air inside the assembled nursing bottle. Even when an attempt is made to totally fill the sack, an air gap is still formed during attachment of the cap to the housing which traps air within the sealed-together sack and cap. Additionally, during extended periods of non-use when the nursing bottle is put down, or stored in a vertical position gravity pulls on the liquid in the sack, which creates a vacuum acting against the nipple. The vacuum pulls air through a feeding opening in the nipple into the sack. Therefore, it becomes necessary for the above reasons to manually expel air from within the sack by applying pressure to the bottom of the sack. Typically, a user inserts their fingers through a bottom opening in the housing in order to pressurize the sack and expel any air at the top of the sack through the feeding opening in the nipple. However, for many users, especially ones with short fingers, this finger-expelling procedure is cumbersome and ineffective, and often leads to split liquid or ineffective expulsion of air.

Accordingly, a number of devices have been developed in an effort to facilitate easier removal of air from these collapsible-sack-containing nursing bottles. U.S. Pat. No. 4,796,767 discloses a pressure applicator for use in expelling air from a flexible liner within a nursing bottle. However, the '767 device requires two-handed use, one for holding the nursing bottle, the other for holding and inserting the applicator within the bottom of the bottle. For many users, two-handed use is inconvenient at best since infants typically cry when they are hungry, thereby necessitating a parent or caretaker hold the infant in order to comfort and quiet them while at the same time preparing a nursing bottle. Therefore, difficulties arise when one fills and prepares a nursing bottle while concurrently comforting an infant.

U.S. Pat. No. 5,109,996 discloses a plunger body designed for insertion within a nursing bottle that prevents the liquid filled sack from filling up with air as the bottle sits during interrupted feeding of an infant. A cap can be affixed to an open bottom end of the plunger to enclose a cavity within the plunger body in which articles, for example spare sacks, can be stored. However, the plunger body of this device by necessity is sized in proportion to the inside dimensions of a nursing bottle. Therefore, the width of the base in relation to the height of the plunger is very small, making the plunger very unstable and unsuitable for use as a self-supported device during single-handed operation.

U.S. Pat. No. 5,356,016 discloses a nursing bottle having an open bottom cylindrical body into which a pair of opposed longitudinal slots are formed for supporting a longitudinally movable internal plunger body. The plunger body has a pair of tab handles extending through the slots which are accessible by a user during use to allow movement of the plunger longitudinally within the body in order to compress a liquid filled sack carried within the body and expel any air therefrom. However, movement of the plunger body requires two-handed operation, the bottle is made from an increased number of parts, and the plunger body complicates the assembly and cleaning of the bottle.

SUMMARY OF THE INVENTION

A self-supporting plunger for use with a nursing bottle assembly of a type having a liquid holding collapsible sack carried within an open-ended cylindrical housing to which a cap and nipple are affixed at one end to trap and seal an open end of the sack within the housing as well as to the cap and nipple. The plunger, preferably formed from a one-piece body, has a base for vertically supporting the body in use, a medial portion or stem vertically extending from the base, and an end portion supported vertically above the base by the medial portion. In use, an open bottom of the nursing bottle is downwardly seated over the plunger end and medial portions during use in order to pressurize a liquid containing sack carried in the bottle to expel any air therefrom. To collect any residual or leaking liquid from the bottle during use of the plunger, a circumferential collecting trough is preferably provided in the base, about the medial portion.

Objects, features, and advantages are to provide a self-supporting plunger enabling single-handed expulsion of air from within the liquid filled sack of a nursing bottle, particularly suited for also collecting liquid lost during pressurization of the sack, which is lightweight, readily formed from a single piece of material in a molding operation, and is simple, stable, rugged, durable, reliable, quick and easy to use, and of relatively simple design and economical manufacture, and when horizontally stored does not tend to roll off countertops and tables.

BRIEF DESCRIPTION OF THE DRAWINGS

These and other objects, features and advantages of this invention will be apparent from the following detailed description, appended claims and accompanying drawings in which:

DETAILED DESCRIPTION OF THE PREFERRED EMBODIMENT

Figure 1:
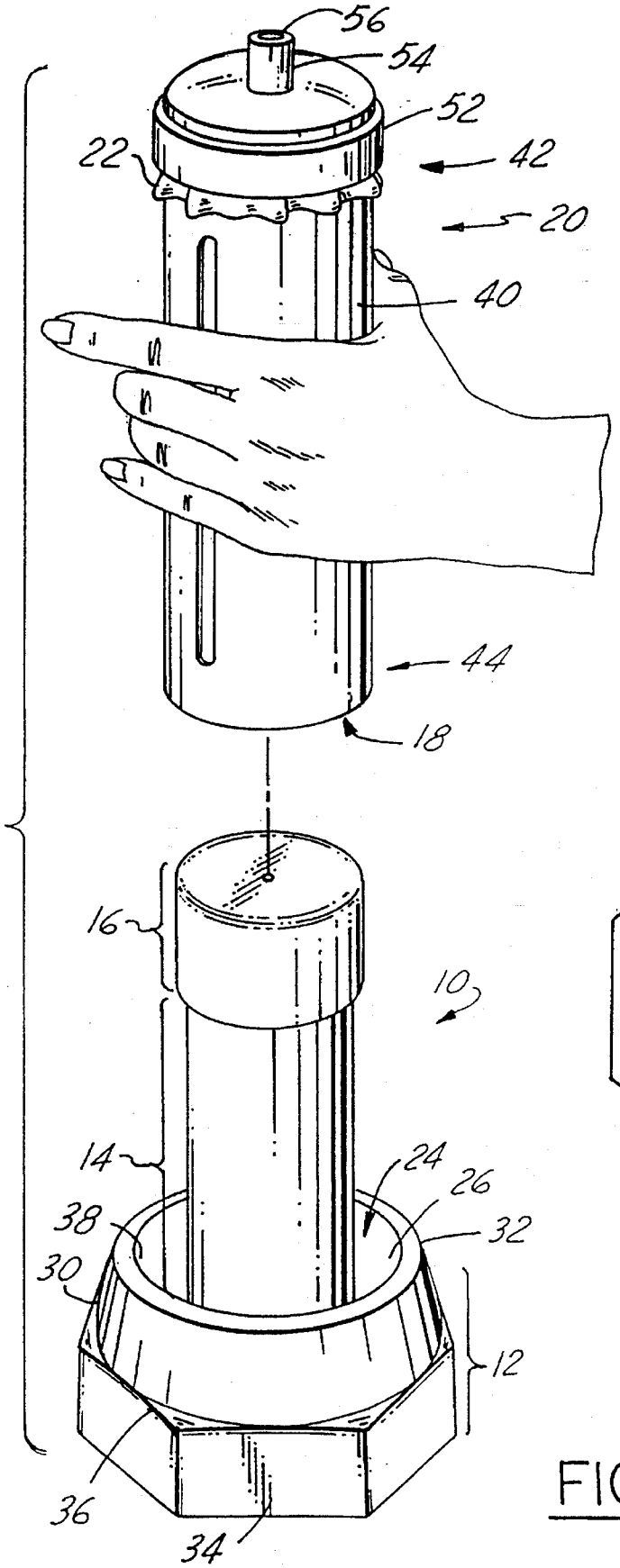
FIG. 1 is a perspective view of a plunger air removal device of this invention depicting a nursing bottle about to be received onto the plunger.

Referring in more detail to the drawings, FIG. 1 illustrates a self-supporting plunger 10 embodying this invention with a base 12, stem or medial portion 14, and tip or end portion 16 for receiving an open bottom end 18 of a nursing bottle 20 to pressurize a liquid containing sack 22 contained within the bottle in order to expel air from within the sack. To enable single handed use of the plunger, the base is sized to support the stem and tip in a vertically extending configuration in a manner which tends to prevent the plunger from tipping over as a nursing bottle is received over the tip and stem. Preferably, the width of the base is sized in relation to the height of the tip so as to make the plunger vertically stable in-use.

Preferably, the plunger base 12 has a circumferential groove, or trough 24 formed in a top portion 26 of the base for collection of liquids spilled from the bottle. During use, the bottle is sealed from leakage. However, when compressing liquid within sack 22 with the plunger 10, leakage can occur due to pressurization within the sack. Furthermore, liquid used to fill the sack can collect on the outer surface of the sack, as well as on various surfaces of the bottle 20 as a result of inadvertent spillage. Typically, the sack is filled over a sink or protected surface so that any spillage is containable. However, the nursing bottle is often carried to various locations within a house, creating a need to use the plunger virtually anywhere. For example, an infant could be fed at a dining room table by a parent. Provision of the trough 24 in-use functions to collect any liquids which might otherwise puddle onto a dining room table, thereby preventing watermarks and stains and protecting a table's fine wood finish in the process.

Figure 2:
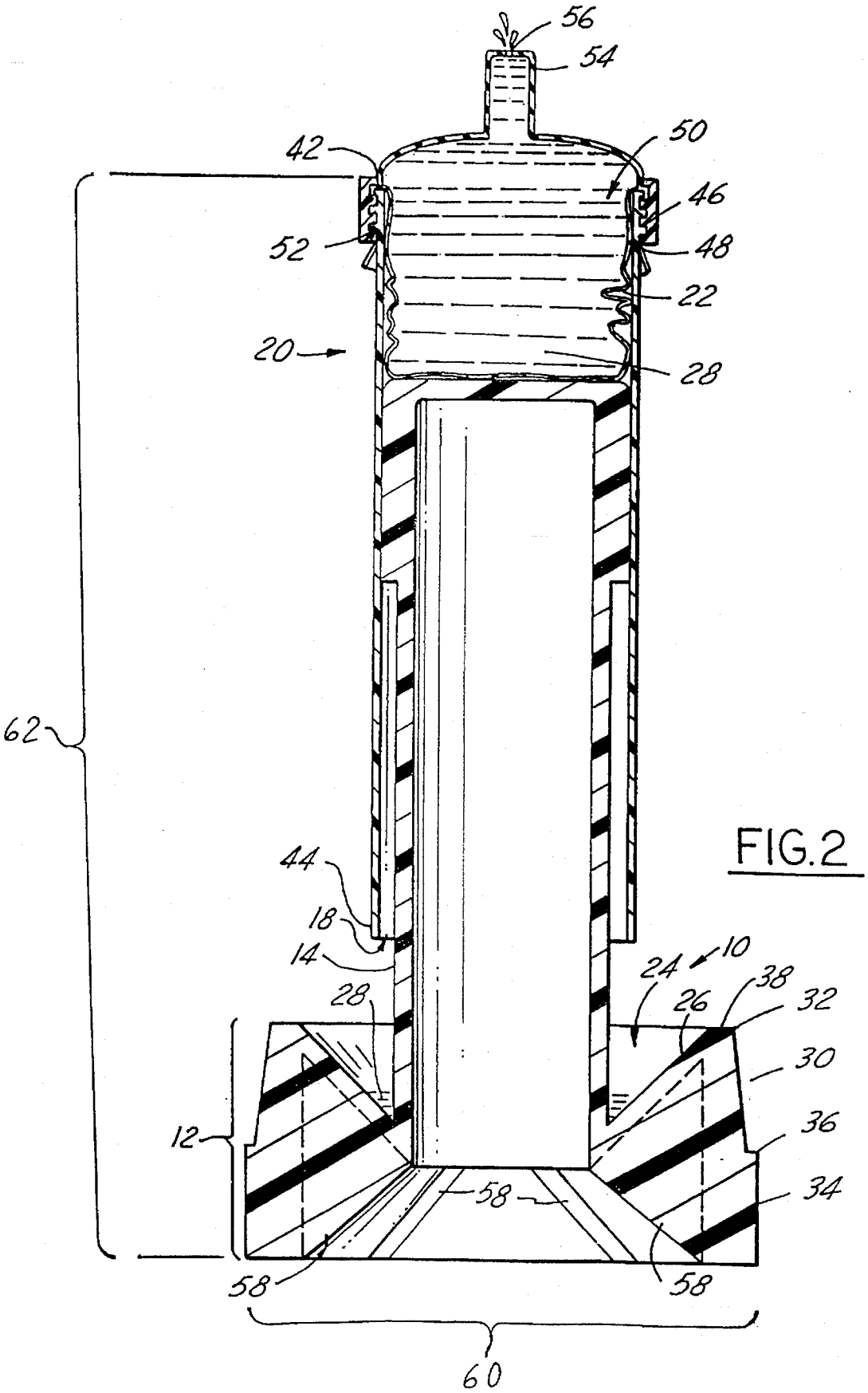
FIG. 2 is a vertical sectional view showing the device of FIG. 1 in use with a nursing bottle.

Preferably, the plunger base 12 has a cylindrical outer surface 30 which mates at a top edge 32 with the top portion 26. Furthermore, at least one vertically extending face portion 34 is preferably formed along a bottom edge 36 of surface 30. The face portion 34 forms a stable resting surface for the plunger 10 when storing the plunger horizontally on a table or counter, thereby preventing the plunger from rolling off the table. As shown in FIGS. 1 and 2, the base 12 has an octagonal arrangement of face portions, or faces 34 arranged circumferentially about the bottom portion of the base. Preferably, the cylindrical outer surface 30 of the base extends upward of the octagonal face portion with a slight radially inward taper so as to ensure engagement of at least one face portion with a horizontal resting surface when storing the plunger on its side. Surface 30 terminates at the top-most edge 32 to form a circumferential lip 38. Lip 38, in combination with trough 24 form the top portion 26 of base 12.

As shown in FIG. 2, the nursing bottle 20 is constructed from a cylindrical housing 40 open at both a top, or proximal end 42 and a bottom, or distal end 44. The top end 42 has threads 46 formed on a circumferential outer surface 48. The bottom end 44 forms the opening 18 through which the plunger 10 is received. Preferably, housing 40 is formed from a molded plastic material. As was already discussed with respect to the prior art, an open end 50 of sack 22 is folded over top end 42 afterwhich a cap 52 is threadingly mated with threads 46 which fills the sack with a cap and retains the sack within the housing 40. Additionally, a nipple 54 formed from a rubber, or flexible silicone material is carried by the cap and seated in sealing engagement with the top end 42 of the housing 40. The nipple further provides a feeding opening 56 through which the liquid 28 is drawn by a feeding infant.

As shown is FIG. 2, stem 14 is preferably sized smaller in diameter than tip 16 in order to facilitate slidable insertion of the tip 16 and stem 14 within the open bottom end 18 of the bottle 20. By sizing the axial length of tip 16 in the same range as its diameter, the tip is much less likely to bind when slid within the bottle 20. Tip 16 forms a piston-shaped end portion closely sized to the inner diameter dimensions of the bottle 20 in order to fully apply pressure to the sack 22 during use. Preferably, for a nursing bottle 20 having an inner diameter of 2 inches, the tip diameter should be about 1.9 inches. Likewise, corresponding stem 14 should have a diameter of 1.75 inches.

Preferably, a smallest dimension for the horizontally extending bottom face of the base 60 is sized in relation to the vertically extending tip height 62 to form an aspect ratio of at least 0.25. For example, a plunger which is ten inches in height from the top-most surface of tip 16 to bottom edge 36 should have a base with a minimum dimension of 2.5 inches in diameter. Preferably, to further enhance stability in use, a ten inch tall plunger should have a base diameter, or minimum dimension of at least five inches.

Alternatively, the base dimension can be sized in relation to the tip height with a much smaller aspect ratio by providing means for affixing the base to a horizontal surface. For example, a suction cup formed from elastic material can be mated within the bottom portion of the base 12 so as to securely affix the plunger to a countertop or table. A suitable suction cup could be formed from an elastomeric material, for example a silicon or rubber. A receiving hole can be provided within the inside of base 12, preferably integrally molded therein, such that an upstanding portion of the suction cup is forcibly received within the hole so as to retain the suction cup therein. In use, pressure is applied to the base of the plunger so as to positively engage the suction cup in sealing engagement with a horizontal surface.

Figure 3:
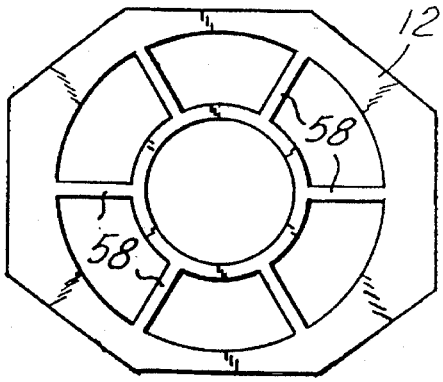
FIG. 3 is a bottom end view of the device of FIGS. 1 and 2.

Preferably, the entire plunger is one unitary piece of molded plastic material. As shown in FIGS. 2 and 3, a plurality of reinforcing ribs 58 are preferably molded integrally within the base 12. The ribs function to stiffen the base and reinforce the attachment of stem 14 while still allowing for construction of the plunger from thin walled plastic material, thereby significantly saving weight and cost while maintaining strength. Alternatively, the plunger can be constructed from several separate pieces which are assembled together with adhesive, fasteners, or carefully sized male and female mating components. For example, stem 14 and tip 16 can be molded from a single piece of plastic material, and base 12 can be molded from a separate piece of plastic material with a hole in the base for removably receiving the bottom end of the stem in order to facilitate break-down of the plunger for ease of storage.

In use, a parent or caretaker places the plunger 10 on a substantially horizontal surface, afterwhich a liquid-filled bottle 20 is grasped and positioned over tip 16. The bottle is lowered over the tip until the sack 22 contacts the tip, which applies pressure to the sack and expells any air pockets that accumulate at the top of the bottle adjacent nipple 54, thereby expelling any air through the feeding opening 56. When feeding momentarily stops, the bottle 20 can be stored atop the plunger 10. The weight of the bottle will prevent introduction of air through the feeding opening 56. Furthermore, any liquid that slowly leaks out of the opening as a result of the bottle's weight will be collected in the trough 24.

Due to the compact one-piece construction, the plunger 10 can readily be carried in a diaper bag for use when eating at a restaurant or when traveling on the road. Additionally, the simple self-supporting construction is easily used by novice care-givers; for example, grandparents, relatives, and friends who have little experience using collapsible sack-type bottles will find the device easy to use. Furthermore, slight modifications to the plunger can facilitate in-car use of the device while traveling; for example, a suction cup provided in the base can facilitate mounting of the plunger to a vehicle dash panel or console.

It is to be understood that the invention is not limited to the exact construction illustrated and described above, but that various changes and modifications may be made without departing from the spirit and scope of the invention as defined in the following claims.

I claim:

1. An improved plunger for use with a nursing bottle assembly having a liquid collapsible sack and an open bottom end, the plunger comprising:

a body having a base provided at a proximal end of said body, said base constructed and arranged for supporting the body in use in an upright position, an axial elongate end portion depending from said base, said end portion sized for slidable insertion within the open bottom end of the bottle, wherein the plunger in use is placed atop a horizontal surface such that said base supports said end portion in a generally vertically upwardly extending arrangement so as to facilitate substantially single-handed use of the plunger by a user to expel air from within a nursing bottle sack, said plunger further comprising a circumferential trough provided in said base portion, said trough constructed and arranged to collect any liquid discharged during fluid compression of the sack.

2. The improved plunger of claim 1 wherein said body is formed of a one-piece unitary construction.

3. The improved plunger of claim 2 wherein said one-piece unitary body is molded from plastic material.

4. An improved plunger for use with a nursing bottle assembly of a type having a liquid holding collapsible sack open at a top end and closed at a bottom end which is inserted into a protective cylindrical housing open at both a bottom and top end, and wherein a cap having a nipple is mated with the top end of the protective housing while at the same time overlying the open top end of the collapsible sack to retain the collapsible sack inside the protective housing in sealing engagement with the cap and nipple, wherein the plunger in use is inserted into the open bottom end of the cylindrical housing to compress the fluid containing portion of the collapsible sack and expel any air therefrom through the nipple, the plunger comprising:

a one piece unitary body having;

a base provided at a proximal end of said body, said base constructed and arranged for supporting the body in use in an upright position, an end portion provided at a distal end of said body opposite said base, said end portion sized for slidable insertion within said protective cylindrical housing from the bottom end, and a medial portion extending between said base and end portion constructed and arranged to support said base and end portions in spaced apart relation, wherein at least a portion of said medial portion adjacent said end portion is sized to fit within said protective cylindrical housing, wherein in use the plunger is placed atop a horizontal surface such that said base supports said end portion and medial portion in a vertically upwardly extending arrangement so as to facilitate substantially single-handed use of the plunger by a user to expel air from within the collapsible sack, said plunger further comprising a circumferential trough provided in said base portion and encircling said medial portion which in use extends upwardly therefrom, said trough constructed and arranged to collect any liquid discharged during fluid compression of the sack.

5. The plunger of claim 4 further comprising at least one outer face portion provided on a vertical outer surface of said base as supported in a vertical configuration, said face portion having a non-circumferential geometry with respect to a central axis of the plunger so as to prevent the plunger from rolling when supported in a substantially horizontal configuration on a horizontal surface during non-use.

6. The plunger of claim 5 wherein said base comprises a plurality of said outer face portions constructed and arranged to form an octagon.

7. The plunger of claim 4 wherein said base, said end portion, and said medial portion are formed as surfaces of revolution constructed about a common central axis.

8. The plunger of claim 4 wherein said one piece unitary body is formed from a plastic material.

9. The plunger of claim 4 wherein said end portion is a cylindrical piston having a substantially flat top.

10. The plunger of claim 4 having a base mean effective diameter to plunger height ratio of at least 0.25.

* * * * *